US011987893B2

(12) United States Patent
Pal et al.

(10) Patent No.: US 11,987,893 B2
(45) Date of Patent: May 21, 2024

(54) SYSTEM AND METHOD FOR EXTRACTING OXYGEN FROM POWDERED METAL OXIDES

(71) Applicants: Airbus Defence and Space GmbH, Taufkirchen (DE); Fraunhofer-Gesellschaft zur Förderung der angewandten Forschung e.V., Munich (DE)

(72) Inventors: Uday B. Pal, Framingham, MA (US); Achim O. Seidel, Taufkirchen (DE); Peter Quadbeck, Dresden (DE); Astrid Adrian, Taufkirchen (DE)

(73) Assignees: Airbus Defence and Space GmbH, Taufkirchen (DE); Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 165 days.

(21) Appl. No.: 17/509,431

(22) Filed: Oct. 25, 2021

(65) Prior Publication Data

US 2023/0131327 A1 Apr. 27, 2023

(51) Int. Cl.
*C25B 11/02* (2021.01)
*C25B 1/02* (2006.01)
(Continued)

(52) U.S. Cl.
CPC ..... *C25B 11/02* (2013.01); *C25B 1/02* (2013.01); *C25B 11/047* (2021.01); *C25B 13/07* (2021.01)

(58) Field of Classification Search
CPC .. C25B 1/02; C25B 11/02; C25C 5/04; C25C 7/025
(Continued)

(56) References Cited

U.S. PATENT DOCUMENTS 5,976,345 A 11/1999 Pal et al.
6,299,742 B1 10/2001 Pal et al.
(Continued)

FOREIGN PATENT DOCUMENTS

CN 101302630 B 11/2010
CN 108505070 B 7/2019
(Continued)

OTHER PUBLICATIONS

Lomax Bethany A et al: "Proving the viability of an electrochemical process for the simultaneous extraction of oxygen and production of metal alloys from lunar regolith", Planetary and Space Science, Pergamon Press, Oxford, GB, vol. 180, Sep. 19, 2019 (Sep. 19, 2019), XP086043007. 10 pgs.
(Continued)

*Primary Examiner* — Nicholas A Smith
(74) *Attorney, Agent, or Firm* — Lerner David LLP

(57) ABSTRACT

A system for extracting oxygen from powdered metal oxides, the system comprising a container comprising an electrolyte in the form of meltable or molten salt, at least one cathode, at least one anode, a power supply, and a conducting structure, wherein the cathode is shaped as a receptacle having a porous shell, which has an upper opening, the cathode being arranged in the electrolyte with the opening protruding over the electrolyte, wherein the conducting structure comprises a plurality of conducting elements and gaps between the conducting elements, wherein the power supply is connectable to the at least one cathode and the at least one anode to selectively apply an electric potential across the cathode and the anode, wherein the conducting structure is insertable into the cathode, such that the conducting elements reach into an inner space of the cathode, wherein the conducting structure is electrically connectable to the cathode, and wherein the system is adapted for
(Continued)

reducing at least one respective metallic species of at least one metal oxide of feedstock inside the shell of the cathode with inserted conducting structure by applying the electric potential, wherein the potential is greater than the dissociation potential of the at least one metal oxide.

13 Claims, 2 Drawing Sheets

(51) Int. Cl.
*C25B 11/047* (2021.01)
*C25B 13/07* (2021.01)

(58) Field of Classification Search
USPC ..... 204/280, 284
See application file for complete search history.

(56) References Cited

U.S. PATENT DOCUMENTS

| | | | | |
|---|---|---|---|---|
| 6,540,902 | B1 | 4/2003 | Redey et al. | |
| 8,066,861 | B1 | 11/2011 | Park | |
| 9,267,214 | B2 * | 2/2016 | Reddy | C25C 3/24 |
| 2009/0000955 | A1 | 1/2009 | Pal | |
| 2016/0108532 | A1 * | 4/2016 | Powell, IV | C25C 3/04 204/244 |

FOREIGN PATENT DOCUMENTS

| | | | |
|---|---|---|---|
| DE | 10156349 | A1 | 5/2003 |
| EP | 2764137 | B1 | 4/2017 |
| EP | 2935656 | B1 | 8/2017 |
| EP | 2430216 | B1 | 8/2018 |
| EP | 3161189 | B1 | 8/2018 |
| EP | 2640871 | B1 | 10/2018 |
| EP | 2640872 | B1 | 3/2019 |
| EP | 3812483 | A1 | 4/2021 |
| GB | 2534332 | A | 7/2016 |
| JP | 2008 013793 | A | 1/2008 |
| WO | 2007/011669 | A2 | 1/2007 |
| WO | 2017203245 | A1 | 11/2017 |

OTHER PUBLICATIONS

Extended European Search Report for Application No. 22201875.6 dated Apr. 6, 2023. 53 pgs.

* cited by examiner

SYSTEM AND METHOD FOR EXTRACTING OXYGEN FROM POWDERED METAL OXIDES

TECHNICAL FIELD

The invention relates to a system and a method for extracting oxygen from powdered metal oxides.

BACKGROUND OF THE INVENTION

Various electrolysis devices having at least one cathode, which partially delimits a receiving area provided for receiving an oxide-containing feedstock in at least one operating condition and having at least one anode are already known.

Devices to produce metals and transition metals are exemplarily known from GB 2 534 332 A, EP 3 161 189 B1 and EP 2 935 656 B1. They operate by direct reduction of solid or powdered oxide-containing starting materials. Established electrolytic devices and electrolytic processes, such as the SOM process (see e.g. U.S. Pat. Nos. 5,976,345 A and 6,299,742 B1), or FFC process, are aimed in particular at the chemical reduction of metal oxides and transition metal oxides for the production of pure metals or alloys, for example for the production of magnesium, aluminium, silicon, titanium, or tantalum from their oxides.

The respective starting material is in electrical contact with a cathode, with molten halide salts used as an electrolyte. A respective anode assembly typically consists of a graphite or metallic rod, or an oxygen ion-conducting membrane in contact with an appropriate anode and anode current collector. U.S. Pat. No. 8,066,861 B1 and DE 101 56 349 A1 describe electrolysis devices, in which an oxygen ion-conducting membrane is used as part of the anode structure, which is thus not consumed by the process.

A DC voltage is applied between the cathode and the anode assembly at a working temperature of typically 700° C. to 1400° C. The electrochemical processes reduce the starting material to pure metal or alloy at the cathode, and oxygen or an oxygen product is produced at the anode.

Above-mentioned U.S. Pat. Nos. 5,976,345 A and 6,299,742 B1 describe electrolysis devices, in which the respective anode assemblies comprise an anode/current collector and an oxygen ion conducting membrane, which separates the respective anode from the electrolyte. Thus, the oxygen is separated from the electrolysis cell, and high-purity oxygen is directly produced. To increase the lifetime of a ceramic anode, the composition of the salt electrolyte is matched to the ceramic oxygen ion conducting membrane. Fluoride salt mixtures have been proven to be suitable for this application. For the industrial production of metals, devices and processes are used in which several bipolar electrochemical cells are connected in series in an electrolyte bath.

From EP 2 430 216 B1, EP 2 640 871 B1, EP 2 764 137 B1 and EP 2 640 872 B1, continuous processes are known in which the electrolyte bath or the device is typically provided open to its/their surroundings at two points for the introduction and removal of freshly loaded cells or cell stacks. Furthermore, an integrated solution is known from WO 2017/203245 A1, consisting of devices and processes for the electrolytic production of metal powders and direct further processing by means of additive manufacturing processes.

U.S. Pat. No. 6,299,742 B1 and U.S. Pat. No. 5,976,345 A describe an in-situ apparatus and technique for measuring the concentrations and transport properties of easily dissociable oxides in slags, utilizing an electrolyte to separate a reference-gas compartment from the slag of interest. A method and apparatus for metals extraction is also described, which includes a vessel for holding a molten electrolyte.

An oxygen-producing inert anode is described in US 2009/0000955A1. Here, the anode consists of liquid metal silver and stabilized zirconia composites. It is in contact with an oxygen-ion conducting membrane. A cathode positioned to contact a metal oxide is also in contact with the membrane. When a potential is applied between the cathode and the anode, the oxygen species of the electrolyte is transported across the ion-conducting membrane and is oxidized at the anode, and the metallic species are reduced at the cathode.

Space applications and sustainable exploration of space require technologies that enable the use of locally available resources, ideally in their naturally occurring form. Of interest are space-qualified technologies to produce oxygen, water, and fuel from materials present on the Moon, Mars, or in and/or on asteroids. The term "space-qualified" is to be understood as referring to a reusable, low-wear/maintenance device, a process without the use of consumables, and devices with a lightweight and compact design and/or high energy and/or material efficiency.

Of particular interest are technologies for producing oxygen and/or water from oxide containing rock, especially regolith, Martian rock, especially Martian regolith, or asteroidal rock, which is generally available in powdered form with grain sizes typically ranging in the μm up to the mm range. For the reduction of such powdered oxides, a dedicated porous cathode has been described in e.g. EP 3 812 483 A1. Here, the cathode comprises the respective oxide powder, but allows the molten halide electrolyte to pass through. The reduction of the oxides occurs at the triple-phase boundary, where the oxide, the halide salt and the cathode are in contact with each other. As the reaction progresses, more oxide is reduced to metal and becomes part of the cathode. This way the reaction progresses into the oxide material until all the oxide material is reduced to metal or the reaction is stopped for other reasons. The reaction rate is therefore limited by the progression of the triple-phase boundary into the body of the oxide volume.

SUMMARY OF THE INVENTION

It is an object of the invention to provide an alternative generic electrolysis device with improved properties in terms of reduction rate and efficiency for the reduction of powdered oxide starting material.

The object is met by the system for extracting metal and oxygen from powdered metal oxides according to the features of independent claim 1. Advantageous embodiments and further improvements may be gathered from the subclaims and the following description.

A system for extracting oxygen from powdered metal oxides, the system comprising a container comprising an electrolyte in the form of meltable or molten salt, at least one cathode, at least one anode, a power supply, and a conducting structure, wherein the cathode is shaped as a receptacle having a porous shell, which has an upper opening, the cathode being arranged in the electrolyte with the opening protruding over the electrolyte, wherein the conducting structure comprises a plurality of conducting elements and gaps between the conducting elements, wherein the power supply is connectable to the at least one cathode and the at least one anode to selectively apply an electric potential across the cathode and the anode, wherein the conducting structure is insertable into the cathode, such that the conducting elements reach into an inner space of the cathode, wherein the conducting structure is electrically connectable to the cathode, and wherein the system is adapted for reducing at least one respective metallic species of at least one metal oxide of feedstock inside the shell of the cathode with inserted conducting structure by applying the electric potential, wherein the potential is greater than the dissociation potential of the at least one metal oxide.

The system is based on an electrolysis device, which in at least one operating state, is provided for carrying out electrolysis, i.e. a redox reaction. Preferably, the system is provided for a particularly recurring electrolytic production of oxygen from oxide-containing starting material. In this regard, the material may be any kind of mineral and oxide that may particularly be provided in the form of a powder.

The at least one cathode at least partially delimits the receiving space, which in at least one operating state is provided for receiving the feedstock in the form of metal oxide powder or similar. The cathode may thus be shaped in the form of a cup or a cup-like component.

It is conceivable that the at least one anode may be provided in the form of a plurality of anodes. Any inert anode may be used to produce oxygen and reduced metal alloys in this device.

The system may constitute a single electrolysis cell and a power supply attachable thereto. However, it is also conceivable that the system comprises several electrolysis cells, which are to be understood as units having at least two electrodes each, one of which is designed as a cathode and one of which is designed as an anode, and having an electric circuit connecting the two electrodes. In at least one operating state an electrolyte is arranged between the electrodes. The several electrolysis cells may be connected in series. A single power supply or a plurality of power supplies less or equal than the number of electrolysis cells may supply the electrolysis cells with the required potential.

The electrolyte may be any ion-conducting substance. Preferably, the electrolyte comprises a meltable or molten salt, in particular a halide salt. Furthermore, other electrolytes which appear useful to a skilled person are conceivable, such as ionic liquids or aqueous solutions.

The operating temperature may be in a range from about 700° C. to about 1400° C. By applying the potential, the cathode has a negative polarization, leading to releasing oxygen ions from the metal oxide into the electrolyte.

As the reduction reaction takes place at the triple-phase boundary, where the respective metal oxide, the electrolyte and the cathode are in contact with each other, an initial contact area between the cathode on one side, and the metal oxide and the electrolyte on the other side is increased through the conducting structure. This increases the area of the triple-phase boundary, the amount of metal-oxide in contact with the triple-phase boundary, and, consequently, the reaction rate. This may be achieved by any suitable conducting structure for enlarging the contact area of the cathode with the metal-oxide material. For example, the conducting structure may comprise an electrically conducting mesh, lattice structure or porous structure inside the cathode or contact pins protruding from the cathode into the metal-oxide material.

The system thus increases the surface area of the cathode and therefore the initial area of the triple-phase boundary. Furthermore, the average distance between the cathode elements and the metal-oxide is reduced. Both aspects lead to a clear increase in efficiency and reduction of reaction time of the process to be carried out by the system.

It is further considered that the process may be carried out on Earth under normal gravity or in space under conditions of reduced or increased gravity. In the following, the denomination "g" refers to the value of gravitational acceleration on Earth, i.e. of 9.81 $m/s^2$. However, the system method may also be operated in space, such as at microgravity in a spacecraft, in a process in a spacecraft at accelerations of $10^{-6}$ g to 10 g, on a planet, such as Mars, and/or on a satellite, such as the Moon. In particular, the g-values are to be understood on a planet and/or an asteroid or in a flying spacecraft. In principle, however, a g-value can be drastically increased procedurally, such as to 100 g. For example, a facility and/or reactor may/may not be subjected to an artificial process acceleration that deviates from the specified g-values. In particular, "conditions of reduced gravity" are intended to mean conditions, in which a gravity effect of at most 0.9 g, advantageously of at least up to $10^{-3}$ g, preferably of at least up to $10^{-6}$ g, and particularly preferably of at least up to $10^{-8}$ g, is effective. Furthermore, the term "conditions of increased gravity" shall in particular be understood as conditions, in which a gravity effect of at least 1.1 g, preferably up to a maximum of 10 g, is effective. The gravity effect may be generated by gravity and/or artificially by acceleration. The system may advantageously be operated in life support systems and/or air conditioning systems in space, such as spacecraft, habitats in space and/or manned systems.

In an embodiment, the potential may be less than the dissociation potential of the electrolyte.

In an embodiment, the conducting structure may be designed to be insertable into the cathode through the upper opening. However, other variants are also conceivable. For example, the cathode may be designed to be dismantled, in which case the conducting structure may be introduced in a different way.

The conducting structure may comprise a wire mesh. The at least one wire mesh may comprise a plurality of mesh cells arranged on a common plane, in particular in form of a regular pattern.

As an alternative or in addition thereto, the conducting structure may comprise a plurality of pins arranged at a distance to each other. The pins may extend from a common plate into the receiving space of the cathode. The pins may be provided in the form of an array and may particularly constitute a regular pattern at least in a section.

The electrolyte may comprise a meltable or molten salt. It is particularly advantageous if the electrolyte comprises a halide salt.

The anode may comprise at least one selective oxygen pump. The oxygen pump may comprise yttria-stabilized zirconia. The oxygen pump allows to provide an adjustable oxygen partial pressure. At least in this case, the potential does not need to be less than the dissociation potential of the electrolyte.

The system may further comprise a cover, which is designed for covering a top opening of the container, thereby enclosing a seal with the top opening. The seal comprises a sufficient chemical resistance.

In analogy to the above described system, the invention further relates to a method for extracting oxygen from powdered metal oxides through an electrolysis cell comprising a container, at least one cathode shaped as a receptacle having a porous shell with an upper opening, and at least one anode, the method comprising providing an oxygen ion conducting electrolyte powder into the container, such that the electrolyte surrounds the shell of the cathode at least partially, inserting a conducting structure having a plurality of conducting elements and gaps between the conducting elements into the cathode, such that the conducting elements reach into a receiving space of the cathode, electrically connecting the conducting structure to the cathode, providing a feedstock comprising at least one metal oxide in powdered form into the upper opening of the at least one cathode, and applying an electric potential across the cathode and the anode, the cathode being in communication with the electrolyte and the anode being in communication with the electrolyte and the feedstock, such that at least one respective metallic species of the at least one metal oxide is reduced at the cathode and oxygen is oxidized at the anode to form molecular oxygen, wherein the potential across the cathode and the anode is greater than the dissociation potential of the at least one metal oxide.

The feedstock may comprise at least one of a group of materials or a chemical compound comprising at least one of the group of materials, the group consisting of iron, titanium, and regolith. Regolith may comprise several different metal oxide compounds, which may also comprise aluminium, magnesium, and silicon.

The electrolyte may comprise a meltable or molten salt, in particular a halide salt.

The anode may also comprise at least one selective oxygen pump, in particular yttria-stabilized zirconia.

The electrolysis cell may be operated at a temperature greater than about 500° C. In particular, the electrolysis cell may be operated at a temperature in the range of about 500° C. to about 1400° C.

The method may further comprise collecting molecular oxygen at the anode. With the method described herein, high-purity oxygen is produced in parallel to metal powder and is to be collected for further use and/or processing at the anode.

BRIEF DESCRIPTION OF THE FIGURES

In the following, the attached drawings are used to illustrate exemplary embodiments in more detail. The illustrations are schematic and not to scale. Identical reference numerals refer to identical or similar elements. They show.

DETAILED DESCRIPTION OF EXEMPLARY EMBODIMENTS

Figure 1:
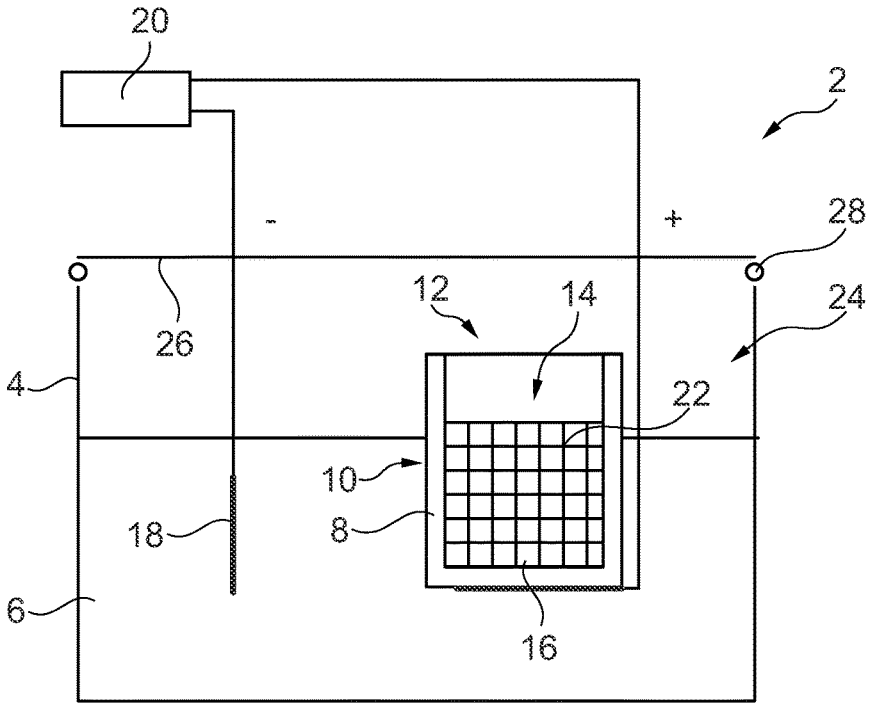
FIG. 1 a simplified schematic view of the system in an embodiment of the system, FIG. 2 a simplified schematic view of the system in another embodiment of the system, and FIG. 3 a method in a block-oriented, schematic view.

FIG. 1 shows a system 2 for extracting oxygen from powdered metal oxides in a schematic view. The system 2 comprises a container 4, in which an electrolyte 6 in the form of a molten salt is provided. The molten salt may be any suitable molten salt used for electrolytic reduction. For example, the salt may be a halide salt, a suitable mixture of calcium fluoride, magnesium fluoride, and yttrium fluoride, or a calcium chloride salt comprising a portion of calcium oxide.

A cathode 8, which has a cup shape, comprises a porous shell 10 and an upper opening 12. Inside the shell 10, a receiving space 14 is defined, which holds a feedstock 16 in the form of a metal oxide powder to be reduced. The metal oxide powder may comprise any suitable metal oxide. A number of metal oxides have been reduced using direct electrolytic processes such as the SOM process or FFC process and are known in the prior art, for example, titanium oxide or tantalum oxide.

An anode 18 is arranged in the electrolyte 16. Both the anode 18 and the cathode 8 are connected to a power supply 20 to apply a potential between the cathode 8 and its associated metal oxide on the one hand and the anode 18 on the other hand. Furthermore, a conducting structure 22 in the form of a wire mesh is inserted into the receiving space 14 of the cathode 8 and is in electrical contact with the cathode 8. The conducting structure 22 is in contact with and surrounded by the feedstock 16. When a potential is applied across the anode 18 and the cathode 8, the conducting structure 22 in addition to the shell 10 acts as a cathode. The active surface of the cathode 8 is thus enlarged. Hence, the surface area where the reduction reaction takes place is enlarged, which results in the reduction of a higher quantity of metal oxide and therefore more oxygen production per time. Furthermore, an average distance between the cathode 8 and the metal-oxide 16 is reduced, which results in a faster reduction process.

The container 4 comprises a top opening 24 at an upper surface, through which the interior space of the container 4 is accessible. The top opening 24 is coverable by a cover 26. For sealing the interior space, a suitable, chemically resistant seal 28 is arranged between the top opening 24 and the cover 26. The container may comprise any suitable chemically resistant material, such as a stainless steel or a ceramic.

Figure 2:
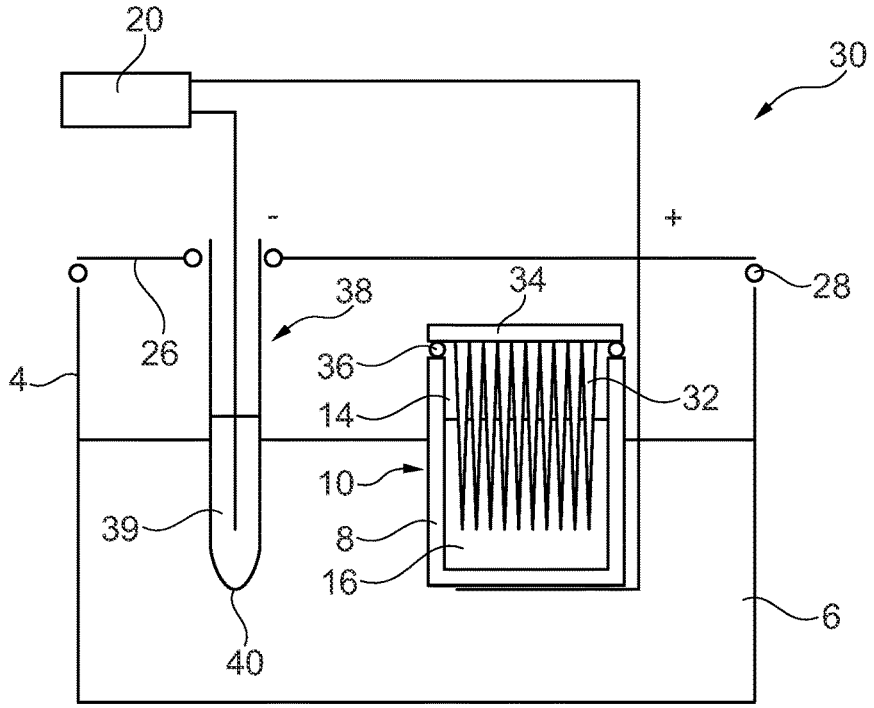

FIG. 2 shows a modified system 30 for extracting oxygen from powdered metal oxides. Here, instead of a wire mesh, a conducting structure 32 in the form of a plurality of pins is provided, which are attached to a common plate 34. The plate 34 covers the upper opening 12 of the cathode 8 and encloses a conducting seal element 36 with the upper opening 12.

An anode 38 is provided, which comprises at least one selective oxygen pump 40. The oxygen pump 40 comprises a solid electrolyte membrane, e.g. a zirconium oxide element, which is provided for a selective transfer of oxygen from the receiving area, i.e. outside the anode 38, into a pumping space, i.e. an interior of the anode 38. The zirconium oxide ceramic is stabilized, in particular with other oxides, such as calcium oxide (CaO), magnesium oxide (MgO) and/or yttrium oxide (Y2O3). However, it may comprise any elements which appear useful to a person skilled in the art. For example an element comprising titanium oxide, vanadium oxide, niobium oxide or perovskite, or a combination of the named oxides may be used. The respective oxides may in each case in turn be stabilized by another oxide.

The anode 38 may comprise liquid silver 39 to serve as a medium to carry out a charge-transfer reaction at the interface between the liquid silver and the membrane. Oxygen, which enters the liquid silver anode through the oxygen-ion-conducting membrane, evolves as oxygen gas, since silver oxide is not stable at the operating temperature. Silver has low vapor pressure, high oxygen solubility and high oxygen diffusivity in this temperature range. Other oxygen-producing anodes 38 may be used if they are stable under the oxidizing conditions of the anode 38.

Figure 3:
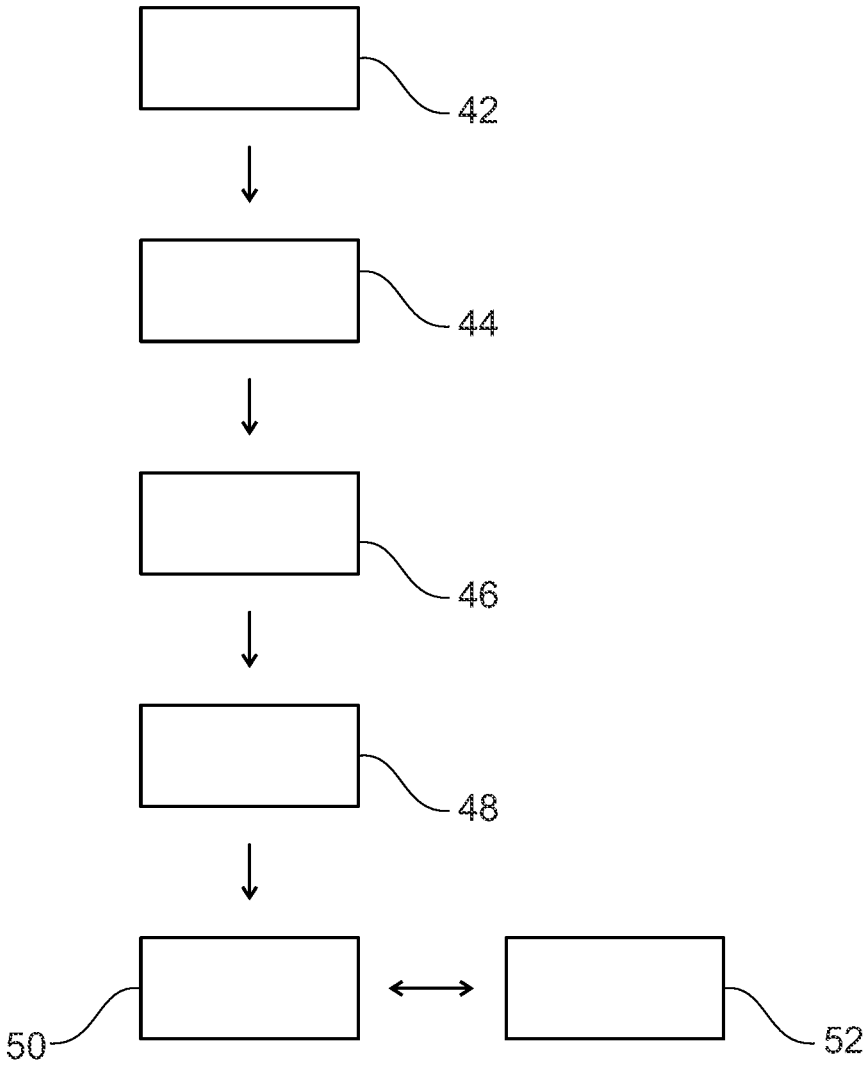

FIG. 3 shows a method for extracting oxygen from powdered metal oxides through an electrolysis cell comprising a container, at least one cathode shaped as a receptacle having a porous shell with an upper opening, and at least one anode as described above. The method comprises providing 42 an oxygen ion conducting electrolyte powder into the container, such that the electrolyte surrounds the shell of the cathode at least partially, inserting 44 a conducting structure having a plurality of conducting elements and gaps between the conducting elements into the cathode, such that the conducting elements reach into a receiving space of the cathode, electrically connecting 46 the conducting structure to the cathode, providing 48 a feedstock comprising at least one metal oxide in powdered form into the upper opening of the at least one cathode, and applying 50 an electric potential across the cathode and the anode, the cathode being in communication with the electrolyte and the anode being in communication with the electrolyte and the feedstock, such that at least one respective metallic species of the at least one metal oxide is reduced at the cathode and oxygen is oxidized at the anode to form molecular oxygen. As mentioned above, the potential across the cathode and the anode is greater than the dissociation potential of the at least one metal oxide. The method may further comprise collecting 52 molecular oxygen at the anode.

REFERENCE NUMERALS

2 system for extracting oxygen
4 container
6 electrolyte
8 cathode
10 porous shell
12 upper opening
14 receiving space
16 feedstock
18 anode
20 power supply
22 conducting structure (wire mesh)
24 top opening
26 cover
28 seal
30 system for extracting oxygen
32 conducting structure (pins)
34 plate
36 seal element
38 anode
39 liquid silver
40 oxygen pump
42 providing electrolyte powder
44 inserting conducting structure
46 electrically connecting the conducting structure
48 providing feedstock
50 applying an electric potential
52 collecting molecular oxygen

The invention claimed is:

1. A system for extracting oxygen from powdered metal oxides, the system comprising:

a container comprising an electrolyte, at least one cathode, at least one anode, a power supply, and a conducting structure, wherein the cathode is shaped as a receptacle having a porous shell, which has an upper opening, the cathode being arranged in the electrolyte with the opening protruding over the electrolyte, wherein the conducting structure comprises a plurality of conducting elements and gaps between the conducting elements, wherein the power supply is connectable to the at least one cathode and the at least one anode to selectively apply an electric potential across the cathode and the anode, wherein the conducting structure is insertable into the cathode, such that the conducting elements reach into a receiving space of the cathode, wherein the conducting structure is electrically connectable to the cathode, and wherein the system is adapted for reducing at least one respective metallic species of at least one metal oxide of feedstock inside the shell of the cathode with inserted conducting structure by applying the electric potential, wherein the potential is greater than the dissociation potential of the at least one metal oxide; and wherein the conducting structure comprises a plurality of pins arranged at a distance to each other.

2. The system of claim 1, wherein the electrolyte comprises a meltable or molten salt.

3. The system of claim 2, wherein the electrolyte comprises a halide salt.

4. The system of claim 1, wherein the anode comprises at least one selective oxygen pump.

5. The system of claim 4, wherein the oxygen pump comprises yttria-stabilized zirconia.

6. The system of claim 1, further comprising a cover configured for covering a top opening of the container, thereby enclosing a seal with the top opening.

7. A method for extracting oxygen from powdered metal oxides through an electrolysis cell comprising a container, at least one cathode shaped as a receptacle having a porous shell with an upper opening, and at least one anode, the method comprising:

providing an oxygen ion conducting electrolyte powder into the container, such that the electrolyte surrounds the shell of the cathode at least partially, inserting a conducting structure having a plurality of conducting elements and gaps between the conducting elements into the cathode, such that the conducting elements reach into a receiving space of the cathode, electrically connecting the conducting structure to the cathode, providing a feedstock comprising at least one metal oxide in powdered form into the upper opening of the at least one cathode, and applying an electric potential across the cathode and the anode, the cathode being in communication with the electrolyte and the anode being in communication with the electrolyte and the feedstock, such that at least one respective metallic species of the at least one metal oxide is reduced at the cathode and oxygen is oxidized at the anode to form molecular oxygen, wherein the potential across the cathode and the anode is greater than the dissociation potential of the at least one metal oxide;

wherein the conducting structure comprises a plurality of pins arranged at a distance to each other.

8. The method of claim 7, wherein the feedstock comprises at least one of a group of materials or a chemical compound comprising at least one of the group of materials, the group consisting of:

iron, titanium, regolith.

9. The method of claim 7, wherein the electrolyte comprises a meltable or molten salt comprising a halide salt.

10. The method of claim 7, wherein the anode comprises at least one selective oxygen pump comprising yttria-stabilized zirconia.

11. The method of claim 7, wherein the electrolysis cell is operated at a temperature greater than about 500° C.

12. The method of claim 7, wherein the electrolysis cell is operated at a temperature in the range of about 500° C. to about 1400° C.

13. The method of claim 7, further comprising collecting molecular oxygen at the anode.

* * * * *